US005171612A

United States Patent [19]

Sollinger

[11] Patent Number: 5,171,612

[45] Date of Patent: Dec. 15, 1992

[54] PROCESS FOR DOUBLE COATING A TRAVELING WEB WITHOUT AN INTERMEDIATE DRYING STEP

[75] Inventor: Hans-Peter Sollinger, Heidenheim, Fed. Rep. of Germany

[73] Assignee: J. M. Voith GmbH, Heidenheim, Fed. Rep. of Germany

[21] Appl. No.: 818,746

[22] Filed: Jan. 7, 1992

Related U.S. Application Data

[63] Continuation of Ser. No. 730,018, Jul. 12, 1991, abandoned, which is a continuation of Ser. No. 453,591, Dec. 20, 1989, abandoned, which is a continuation-in-part of Ser. No. 385,212, Jul. 25, 1989, Pat. No. 4,980,207.

[51] Int. Cl.[5] ..... B05D 1/36

[52] U.S. Cl. ..... 427/359; 427/361; 427/402; 427/428; 427/365

[58] Field of Search ..... 427/359, 361, 365, 402, 427/428; 118/126, 410, 411, 414

[56] References Cited

U.S. PATENT DOCUMENTS

| | | | |
|---|---|---|---|
| 2,582,407 | 1/1952 | Barrett et al. | 427/428 |
| 2,937,955 | 5/1960 | Loomer | 427/428 |
| 2,970,564 | 2/1961 | Warner | 118/249 |
| 3,202,536 | 8/1965 | Brezinski | 427/414 |
| 3,387,585 | 6/1968 | Farrell | 118/104 |
| 3,511,696 | 6/1967 | Murray | 427/428 |
| 4,177,304 | 12/1979 | Berry | 427/428 |
| 4,250,211 | 2/1981 | Damrau et al. | 427/356 |
| 4,848,268 | 7/1989 | Sollinger et al. | 118/227 |
| 4,980,207 | 12/1990 | Sollinger | 427/402 |

FOREIGN PATENT DOCUMENTS 882640 10/1971 Canada .

*Primary Examiner*—Michael Lusignan
*Assistant Examiner*—Benjamin L. Utech
*Attorney, Agent, or Firm*—Baker & Daniels

[57] ABSTRACT

A coating process for coating traveling webs comprises applying a first coating layer of a pigment substance on a portion of the shell surface of a rotatable roll not covered by the material web, and pressing the pigment substance onto the web in a press gap, thereby impregnating the web. This makes it possible to apply with maximum uniformity and without web breaks and wrinkles a second coating layer of a pigment substance immediately successive to the application of the first layer, while the first layer is still moist.

2 Claims, 1 Drawing Sheet

PROCESS FOR DOUBLE COATING A TRAVELING WEB WITHOUT AN INTERMEDIATE DRYING STEP

This is a continuation of application Ser. No. 07/730.018, filed Jul. 12, 1991, now abandoned, which is a continuation of application Ser. No. 07/453,591, filed Dec. 20, 1989, now abandoned, which is a continuation-in-part of application Ser. No. 07/385,212, filed Jul. 25, 1989, now U.S. Pat. No. 4,980,207.

BACKGROUND OF THE INVENTION

The invention concerns an applicator in which two immediately successive layers are applied on one another while the first layer is still moist, and where for both the first and second coating operation there is at least one rotatable roll provided which carries the web and where the second coating device features a smoothing scraper. The process for the coating of traveling webs, with two successive coating operations where the layer applied first is still moist as the second layer is applied, is known from U.S. Pat. No. 3,202,536. The two coating stations are arranged both on a single roll carrying the web and on two successive rolls. A similar device is known also from Canadian Patent No. 882 640. The latter differs from the former in that the application in the first coating station occurs by means of an applicator roll. The layer applied first is then made uniform by means of a blade, the excess being scraped off. In the case of the other device, a scraping by means of a scraper blade occurs as well in the first coating station.

SUMMARY OF THE INVENTION

The invention proposes a new coating device having the advantage that the coating is applied first lightly on the web, with a uniform pressing of the first coating quantity into the web taking place due to the press gap between the first web guide roll and the press roll. Thus, the web is quasi impregnated, and it is readily possible to uniformly apply the finish layer with the second coating device. Due to the press gap, no significant stress occurs, specifically no traction or squeezing stress on the web. The scraper blade which easily tends to deform the web or even causes web breaks is avoided. For a uniform application of a dosed amount it is very advantageous to use a rolling blade which is grooved on its circumference. The grooves may be very fine, obtaining a very uniform application.

BRIEF DESCRIPTION OF THE DRAWINGS

The invention will be explained hereafter with the aid of three examples illustrated in the figures of the drawing.

DESCRIPTION OF THE PREFERRED EMBODIMENTS

Figure 1:
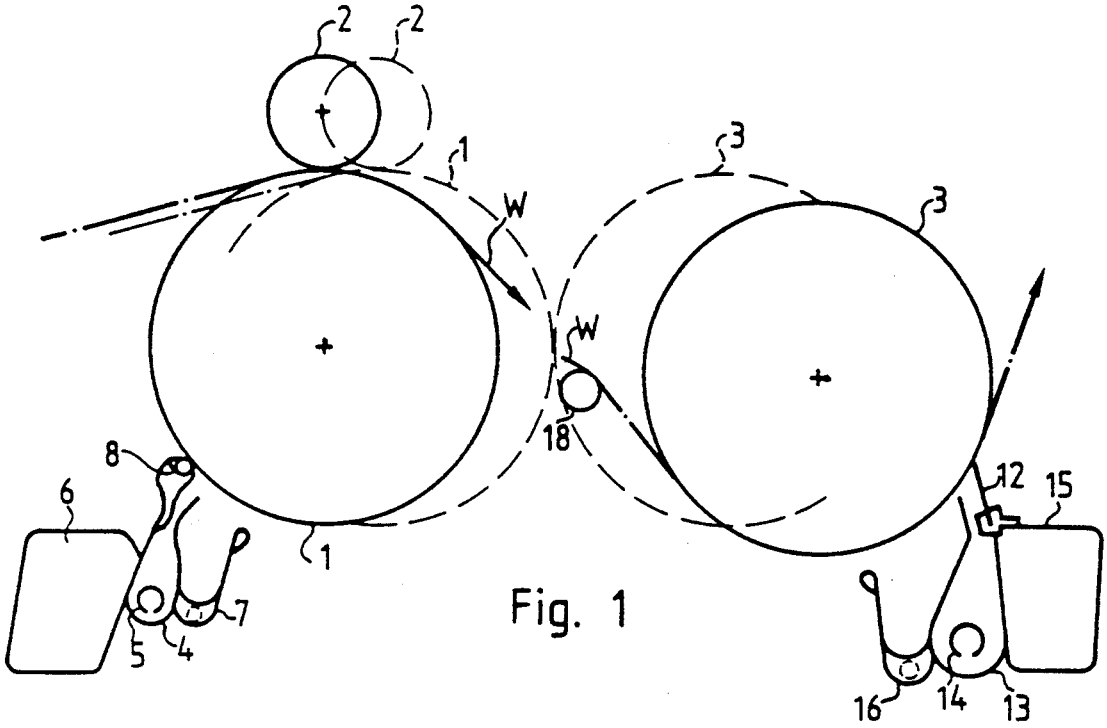
FIG. 1 is an apparatus for coating a paper or board web in accordance with the present invention.

Marked 1, in FIG. 1, is the first web guide roll, i.e., the one of the first coating device, while 2 marks the pertaining press roll and 3 the web guide roll of the second coating device. The threading of the web is marked W. The first coating device features an applicator chamber 4 for the coating or pigment substance, such as kaolin, with the latter being fed into said chamber through the feed pipe 5. In this case, the applicator chamber is fashioned as a nozzle chamber with an overflow permitting excess coating substance to flow into the collector tub 7 which is attached to the applicator chamber 4. Pigment substance exits from the nozzle chamber and is applied on a portion of the shell surface of guide roll 1 not covered by the material web. The applicator chamber 4 is held by a support beam 6. Located on the exit end of the applicator chamber 4, in the direction of rotation of the web guide roll 1, is the dosing element, a rolling blade 8 which preferably features a surface that is provided with peripheral grooves. Provided as second coating device is as well such an applicator chamber 13 with feed pipe 14. Also available is a collecting trough 16 and a support beam 15. Instead of the rolling blade 8, a regular coating blade 12 is provided here on the exit end with regard to the applicator chamber 13, which smooths the second application layer. In the press gap forming between the web guide roll 1 and the press roll 2, the relatively accurately dosed pigment substance is pressed into the web, preferably a paper or cardboard web, thus impregnating the web. The pigment substance includes a solid share and a liquid share, and is applied in such a dosed quantity that at least the liquid share of the pigment substance completely penetrates the material web and the solid share that has not penetrated the material web is firmly connected with the web by the pressing action in the press gap. The web W proceeds then without drying to the second coating device. In doing so it can be passed over a spreader roll so as to avoid wrinkling.

Naturally, the coating blade 12 is in either case forced down in customary fashion by the hold down-means, in such a way that it is in uniform contact with the web guide roll 3 respectively the web, smoothing the coating very uniformly.

The applicator mechanisms with applicator chamber are known, for instance from U.S. Pat. No. 4,250,211, and applicator blades with sump and rolling blade including holder from U.S. Pat. No. 2,970,564. A rolling blade provided with a wire wrapping that forms the peripheral grooves is known, e.g., from U.S. Pat. No. 3,387,585.

The lay of the web and the stress on the web can be considerably equalized yet by web traction, with the aid of a spreader roll 18 incorporated between the two web guide rolls 1 and 3.

Illustrated in FIG. 1, by dash-dot line is a variant where the web guide rolls 1 and 3 are arranged immediately side by side. In the gap formed between the two rolls, the web runs relatively free of friction, but at any rate without significant hold-down forces.

Contact pressure in the nip between rolls 1 and 2 is not possible, since the web stretch and cross expansion between the nip of rolls 1 and 2 and the blade 12 cannot be equalized.

The basic principle of the inventional applicator device is performing the first coating only to an extent such that essentially only an impregnation of the paper is taking place. Therefore, the amount of coating substance applied in the first coating device depends on the absorptivity of the paper, which, among others, is essentially a function of the basis weight of the paper. For wood-free grades, for instance, basis weights of not more than 80 g/m$^2$ are used. On these papers, which due to their greater porosity also have a greater absorptivity, the basis weight of coating applied in the first coating device amounts maximally to 4 g/m$^2$ dry weight, so that overall a coating quantity of at least 8 g/m$^2$ dry weight is applied in both coating devices. In the case of material webs having a basis weight of at least 80 g/m$^2$, the quantity of pigment substance applied in the first layer amounts maximally to 6 g/m$^2$ to 9 g/m$^2$ dry weight. The total application in both coating devices again amounts to at least 8 g/m$^2$ dry weight. The respective groove size amounts cross-sectionally to maximally about 0.012 mm/m$^2$. This applied essentially to wire-wound roll type blades. However, these blades do not have a long service life.

Figure 2:
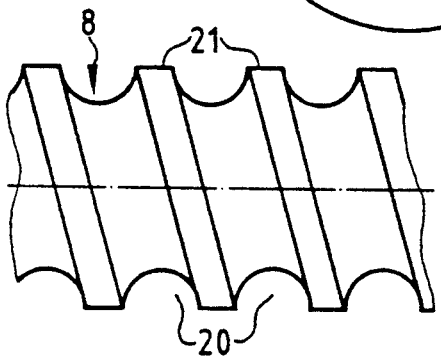
FIG. 2 is a side view of a coating roller of the apparatus of FIG. 1.

Therefore, roll type blades have been developed for the inventional applicator device that make it possible to produce a flawless coating over longer periods of operating time. Such a roll type blade is illustrated in FIG. 2, containing between the grooves 20 lands 21 which in cross-section, viewed parallel to the center axis of the roll type blade, have a surface which is parallel to said center axis.

For the cross-section of these grooves, a value per meter of working widths of the roll type blade of maximally 34 mm$^2$ can be considered as the upper limit.

In the case of papers of lesser quality, i.e., with a basis weight of less than 80 g/m$^2$, the cross-section of the grooves of a wire-wound roll type blade is maximally about 0.006 mm$^2$ for applying a coating layer of about 3 g/m$^2$ to 4 g/m$^2$ maximally by means of the first coating device.

In the second coating device a second layer of pigment substance is applied directly on the material web in that area of the shell surface covered by the web. The second layer is preferably applied to the web about 0.1 seconds after emerging from the press gap of the first coating device, and not later than 0.15 seconds thereafter.

Figure 3:
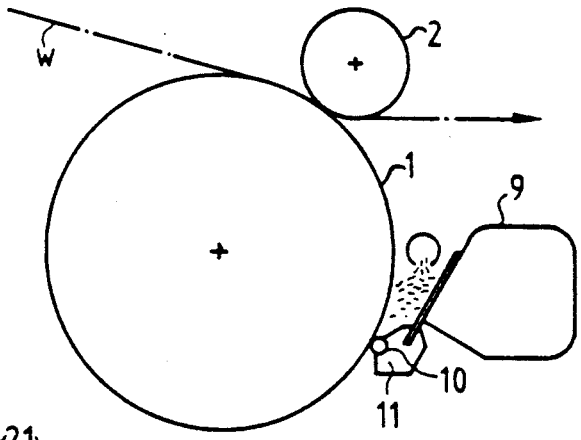
FIG. 3 is an alternative embodiment of an applicator device in accordance with the present invention.

In the arrangement according to FIG. 3, another applicator device is coordinated with the web guide roll 1, on which a holder 11, which together with the support beam 9 forms the sump of coating substance, is provided for the roll type blade 10. Since an open sump is concerned, the required pump capacity is lower here than in the case of FIG. 1.

What is claimed is:

1. Process for coating a running material web with pigment substance including a solid share and a liquid share, said process comprising the steps of:

providing a first coating device including at least one rotatable roll having a shell surface which carries the web;

providing a press gap formed between the rotatable roll of the first coating device and a press roll coordinated therewith, through which press gap the web runs;

providing a second coating device including at least one rotatable roll having a shell surface which carries the web;

applying a dosed quantity of pigment substance as a first coating layer in the first coating device on a portion of the shell surface not covered by the material web, said dosed quantity of pigment substance comprising an amount of coating substance such that at least the liquid share of the substance completely penetrates the material web and the solid share that has not penetrated the material web is connected with the web by pressing in said press gap;

wherein the quantity of pigment substance applied in the first layer amount of maximally 4 g/m$^2$ in the case of material web having a basis weight of less than 80 g/m$^2$, and the quantity applied in the first layer amounts to 6 g/m$^2$ to 9 g/m$^2$ dry weight in the case of a material web having a basis weight of at least 80 g/m$^2$;

pressing the first layer of pigment substance onto the material web in said press gap; and applying a second layer of pigment substance in the second coating device immediately successively to the first layer without any intervening drying step, said second layer being applied in the second coating device directly on the material web in that area of the shell surface covered by the web, said second layer being applied directly onto said first layer not later than 0.15 seconds after said web emerges from the press gap of the first coating device while the first layer is still moist, such that the total pigment substance applied in the first and second layers amounts to at least 8 g/m$^2$ dry weight.

2. The process of claim 1, wherein the second layer is applied to the web about 0.01 second after emerging from the press gap of the first coating device.

* * * * *